US007129812B2

(12) United States Patent
Wada

(10) Patent No.: US 7,129,812 B2
(45) Date of Patent: Oct. 31, 2006

(54) STICK-SHAPED IGNITION COIL HAVING INTERNAL CONNECTING STRUCTURE

(75) Inventor: Jyunichi Wada, Chita-gun (JP)

(73) Assignee: Denso Corporation (JP)

( * ) Notice: Subject to any disclaimer, the term of this patent is extended or adjusted under 35 U.S.C. 154(b) by 11 days.

(21) Appl. No.: 11/046,708

(22) Filed: Feb. 1, 2005

(65) Prior Publication Data

US 2005/0168313 A1 Aug. 4, 2005

(30) Foreign Application Priority Data

Feb. 4, 2004 (JP) ..... 2004-028308
Dec. 16, 2004 (JP) ..... 2004-364596

(51) Int. Cl.
*H01F 27/02* (2006.01)

(52) U.S. Cl. ..... 336/92; 336/90; 336/96

(58) Field of Classification Search ..... 336/92, 336/96, 90; 123/634–635
See application file for complete search history.

(56) References Cited

U.S. PATENT DOCUMENTS 5,794,603 A * 8/1998 Miyamoto ..... 123/634
6,208,231 B1 3/2001 Oosuka et al. ..... 336/107
6,525,636 B1 2/2003 Oosuka et al. ..... 336/90
6,662,794 B1 12/2003 Nagata et al. ..... 123/634
2003/0122645 A1 7/2003 Oosuka et al. ..... 336/96

FOREIGN PATENT DOCUMENTS

JP 10-89219 4/1998
JP 2000-277362 10/2000

OTHER PUBLICATIONS

Korean Examination Report dated Jun. 19, 2006.

* cited by examiner

*Primary Examiner*—Anh Mai
(74) *Attorney, Agent, or Firm*—Nixon & Vanderhye PC

(57) ABSTRACT

A stick-shaped ignition coil includes a primary and secondary coils, a plurality of annular protrusions, a thin film sheet, a sub-assembly and a case. The annular protrusions are integrally formed on the outer circumferential periphery of the upper end portion of the primary coil arranged on the radially outer side. The thin film sheet covers the primary coil and the outer circumferential periphery of the plurality of annular protrusions. The sub-assembly is press-inserted to the outer circumferential periphery of the plurality of annular protrusions via the thin film sheet. The sub-assembly, which is electrically insulative, supports a lead portion of the primary winding. The case is press-inserted to the outer circumferential periphery of the cylindrical member.

25 Claims, 6 Drawing Sheets

STICK-SHAPED IGNITION COIL HAVING INTERNAL CONNECTING STRUCTURE

CROSS REFERENCE TO RELATED APPLICATIONS

This application is based on and incorporates herein by reference Japanese Patent Applications No. 2004-28308 filed on Feb. 4, 2004 and No. 2004-364596 filed on Dec. 16, 2004.

FIELD OF THE INVENTION

The present invention relates to a stick-shaped ignition coil that generates high-voltage electric power supplied to an ignition plug, which ignites mixture gas in an internal combustion engine.

BACKGROUND OF THE INVENTION

A stick-shaped ignition coil includes a coil portion, a control portion, and a tower portion. The coil portion is located in an axially intermediate position of the ignition coil. The control portion is located on the upper end side of the ignition coil. The tower portion is located on the lower end side of the ignition coil. The coil portion is constructed of a cylindrical case that receives a center core, a primary coil, and a secondary coil. The control portion is constructed of a box-shaped case that receives an igniter. The cylindrical case and the box-shaped case are individually formed. Subsequently, the cylindrical case and the box-shaped case are connected to each other.

As shown in FIG. 10, a conventional ignition coil, which is disclosed in JP-A-2000-277362, includes an elongated cylindrical coil case 120 and a circuit case 125 that are integrally connected to each other. The coil case 120 receives a center core, primary and secondary coils (none shown). The circuit case 125 has a connecter 126, and receives an electric circuit (not shown). The coil case 120 and the circuit case 125 are individually formed. Subsequently, the upper outer circumferential periphery of the coil case 120 is press-inserted into a hole portion formed in the bottom portion of the circuit case 125 via multiple protrusions 121. The protrusions 121 are formed on the outer circumferential periphery of the coil case 120, and the protrusions 121 are pressed and deformed when the coil case 120 is press-inserted into the circuit case 125.

The outer diameter of a coil portion of an ignition coil needs to be reduced in recent years. Therefore, a coil case, which receives a center core, primary and secondary coils, is reduced in wall thickness in a conventional ignition coil disclosed in JP-A-2003-51416. In this structure, the coil case having thin wall thickness cannot be stably connected to the circuit case due to insufficient rigidity of the coil case. Therefore, the upper end portion of the coil case is press-inserted into the hole portion of the circuit case, and subsequently, the press-insertion portion between the coil case and the hole portion needs to be filled with glue to enhance rigidity. In this structure, the connecting process becomes complicated. Besides, a supporting portion need to be formed on the end portion of the primary spool to support a lead portion of a primary winding of the primary coil. As a result, the outer diameter of the primary spool becomes large.

SUMMARY OF THE INVENTION

In view of the foregoing problems, it is an object of the present invention to produce a stick-shaped ignition coil that has a structure, in which a coil portion receiving primary and secondary coils is reduced in wall thickness, and a supporting portion, which is formed on an upper end portion of an outer spool to support a lead portion of a primary winding of the primary coil, is downsized.

According to the present invention, a stick-shaped ignition coil, a stick-shaped ignition coil includes a secondary coil, a primary coil, multiple annular protrusions, and a case. The secondary coil includes a secondary spool and a secondary winding. The secondary winding is wound around the secondary spool. The primary coil includes a primary spool and a primary winding. The primary winding is wound around the primary spool. The secondary coil and the primary coil are substantially coaxially arranged. The protrusions are integrally formed on the outer circumferential periphery of the upper end portion of one of the primary coil and the secondary coil that is arranged on the outer circumferential side with respect to the other of the primary coil and the secondary coil. The case is press-inserted to the outer circumferential periphery of the annular protrusions.

The stick-shaped ignition coil may include a thin film sheet. The thin film sheet covers the outer circumferential periphery of one of the primary coil and the secondary coil that is arranged on the outer circumferential side with respect to the other of the primary coil and the secondary coil. The thin film sheet also covers the outer circumferential periphery of the annular protrusions. In this structure, the case is press-inserted to the outer circumferential periphery of the plurality of annular protrusions via the thin film sheet.

The stick-shaped ignition coil may include a cylindrical member that is press-inserted to the outer circumferential periphery of the annular protrusions via the thin film sheet. The cylindrical member is electrically insulative. The cylindrical member supports a lead portion of one of the primary winding and secondary winding. In this structure, the case is press-inserted to the outer circumferential periphery of the cylindrical member.

The stick-shaped ignition coil may include a shrinkable tube, an annular member, and a cylindrical member. The shrinkable tube covers the outer circumferential periphery of one of the primary winding and the secondary winding that is arranged on the outer circumferential side with respect to the other of the primary winding and the secondary winding instead of the thin film sheet. The annular member is press-inserted to the outer circumferential periphery of the annular protrusions. The annular member is electrically insulative. In this structure, the cylindrical member is press-inserted to the outer circumferential periphery of the annular member. The cylindrical member is electrically insulative. The cylindrical member supports the lead portion of one of the primary winding and secondary winding. The case is press-inserted to the outer circumferential periphery of the cylindrical member.

The annular protrusions, which is arranged on the upper side with respect to another of the protrusions, which is arranged on the lowermost side, has an outer circumferential periphery on the upper side thereof. The outer circumferential periphery has a round portion.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS (First Embodiment)

Figure 1:
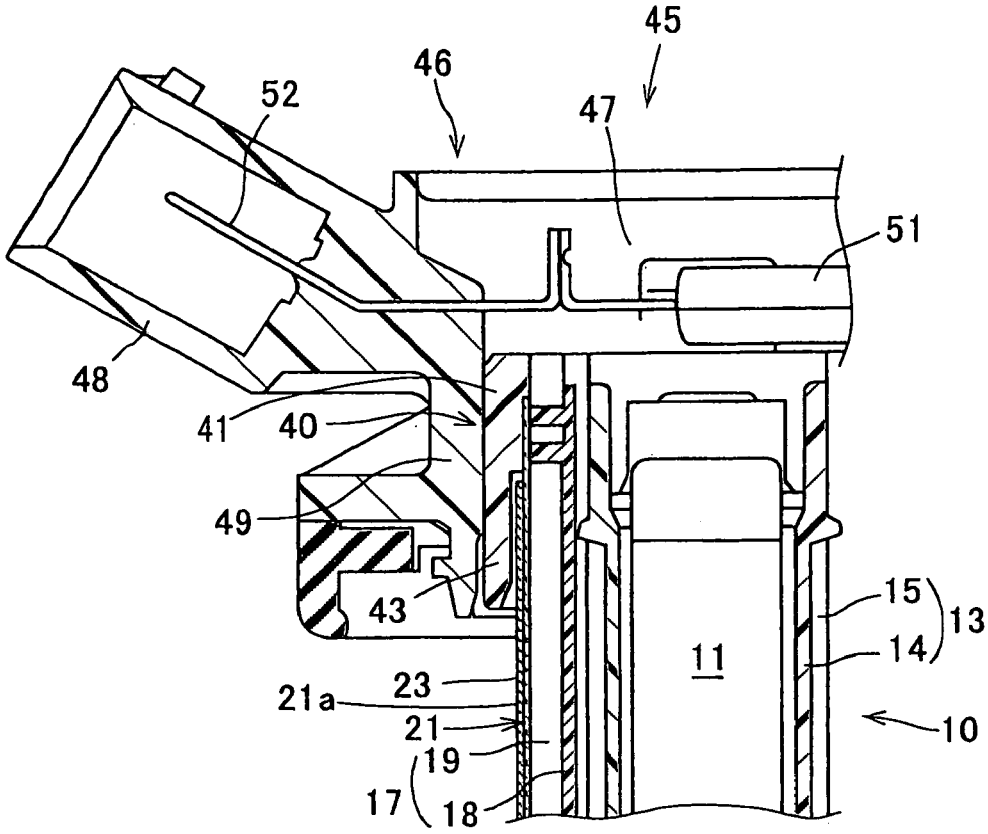
FIG. 1 is a partially cross-sectional side view showing a coil portion and a control portion of an ignition coil according to a first embodiment of the present invention.
Figure 2:
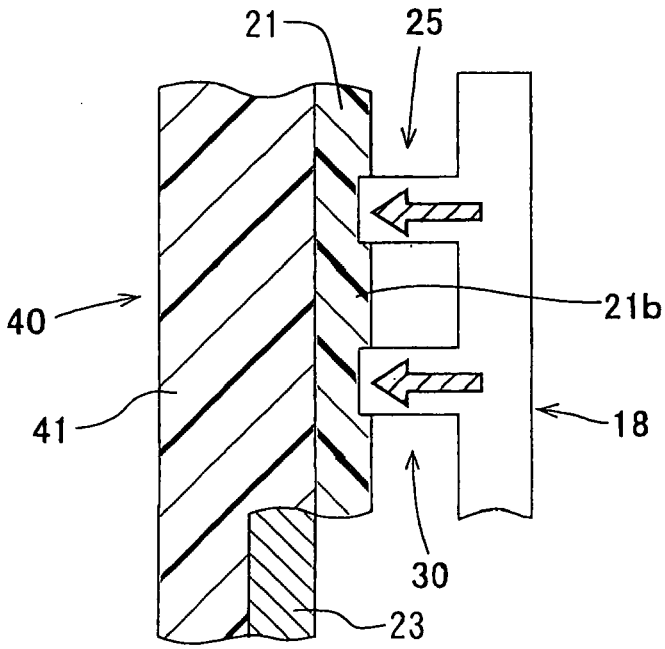
FIG. 2 is a schematic side view showing a primary spool connected to a sub-assembly in the ignition coil according to the first embodiment.
Figure 3:
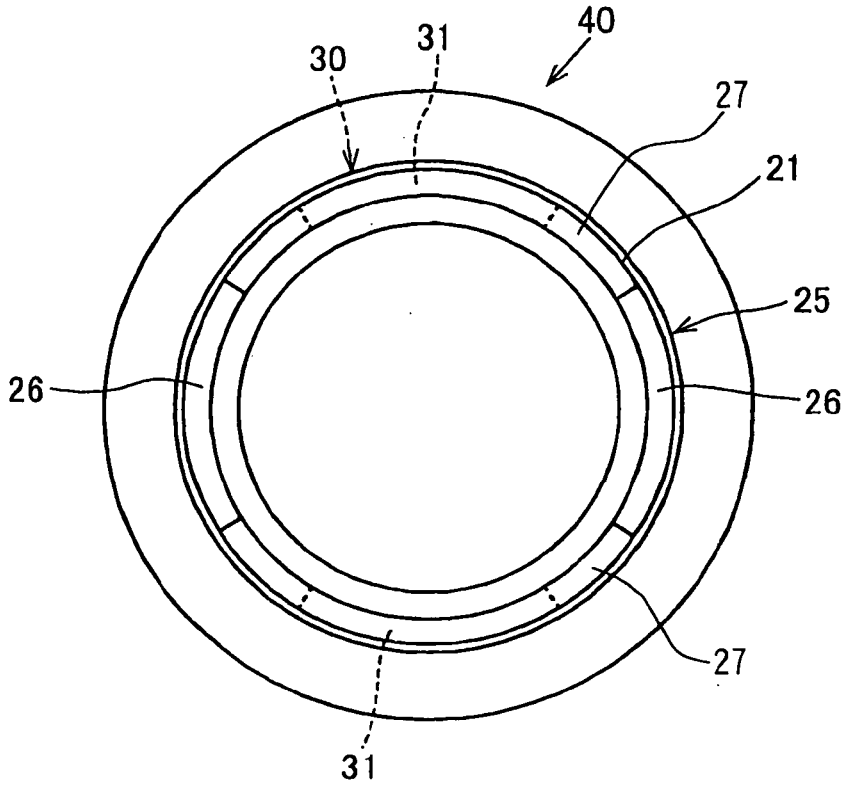
FIG. 3 is a top view showing the primary spool connected to the sub-assembly according to the first embodiment.
Figure 4:
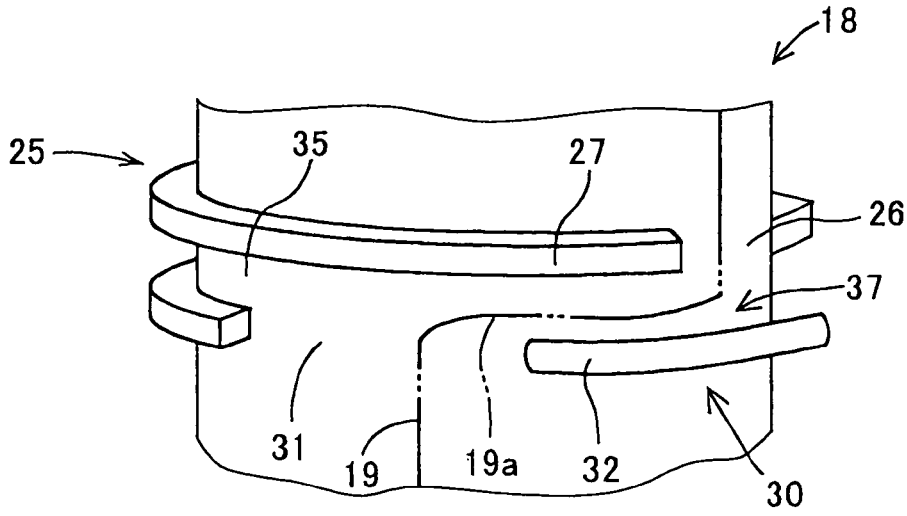
FIG. 4 is a perspective view showing the primary spool according to the first embodiment.

As shown in FIGS. 1, 2, an ignition coil is constructed of a coil portion 10 and a control portion 45 that are connected to each other via a sub-assembly 40. The coil portion 10, which is an intermediate portion of the ignition coil, is inserted into a plughole (not shown) formed in a cylinder block of an internal combustion engine. The coil portion 10 is axially arranged over the middle portion and the inlet portion of the plughole. The control portion, which is the upper end portion of the ignition coil, is seated on the upper face of the cylinder block (not shown).

A center core 11, a secondary coil 13, a primary coil 17, a thin film sheet 21 and an outer core 23 are arranged in the coil portion 10 from the center to the side of the outer periphery in order. The secondary coil 13 includes a secondary spool 14, which is formed in a substantially cylindrical shape, and a secondary winding 15 that is wound around the outer circumferential periphery of the secondary spool 14. The secondary spool 14 is electrically insulative. The primary coil 17 includes a primary spool 18, which is formed in a substantially cylindrical shape, and a primary winding 19 that is wound around the outer circumferential periphery of the primary spool 18. The primary spool 18 is electrically insulative. The thin film sheet 21 is formed of a thin film to be in a cylindrical shape. The thin film sheet 21 has a body portion 21*a* that circumferentially covers the primary winding 19. The outer core 23 is provided on the side of the outer periphery of the body portion 21*a* of the thin film sheet 21.

A first collar portion 25 and a second collar portion 30 are formed on the outer circumferential periphery of the upper end portion of the primary spool 18, which is located on the outer circumferential side of the secondary spool 14 in the coil portion 10. The thin film sheet 21 has an extended portion 21*b* (FIG. 2) that circumferentially covers the first and second collar portions 25, 30. The gap formed between the secondary winding 15 and the primary spool 18, and the gap formed between the primary winding 19 and the thin film sheet 21 in the coil portion 10 are filled with electrically insulative resin (not shown).

As shown in FIGS. 1 to 4, the first collar portion 25 and the second collar portion 30, which are formed on the upper end portion of the primary spool 18 in FIG. 2, are apart from each other for a predetermined length in the axial direction of the primary spool 18. The first and second collar portions 25, 30 form an annular groove 35 (FIG. 4) axially therebetween. The primary winding 19 is wound around a concavity defined by the second collar portion 30.

Two first groove portions 26 (FIG. 3) having a predetermined circumferential length are formed in the first collar portion 25, such that the first groove portions 26 oppose to each other in the radial direction of the primary spool 18. Two protrusions 27 having a predetermined circumferential length are formed in the first collar portion 25, such that the protrusions 27 oppose to each other in the radial direction of the primary spool 18. The first groove portions 26 and the protrusions 27 are alternatively arranged in the circumferential direction of the primary spool 18.

Two second groove portions 31 having a predetermined circumferential length are formed in the second collar portion 30, such that the second groove portions 31 radially oppose to each other. Two protrusions 32 having a predetermined circumferential length are formed in the second collar portion 30, such that the protrusions 32 radially oppose to each other. The second groove portions 31 and the protrusions 32 of the second collar portion 30 are circumferentially alternatively arranged as well as the first groove portions 26 and the protrusions 27 of the first collar portion 25.

The second groove portions 31 of the second collar portion 30 is staggered, i.e. displaced for substantially 90° with respect to the first groove portions 26 of the first collar portion 25 in the circumferential direction of the primary spool 18. Thus, the first groove portions 26, the annular groove 35, and the second groove portions 31 form a bent space 37 having a substantially zigzag shape, i.e., crank shape on the outer circumferential periphery of the primary spool 18.

As referred to FIG. 1, the sub-assembly 40 is formed of an electrically insulative material to be in a substantially cylindrical shape. The sub-assembly 40 is longitudinally substantially uniform in outer diameter. The upper portion (thick-wall portion 41) of the sub-assembly 40 is smaller than the lower portion (thin-wall portion 43) of the sub-assembly 40 in inner diameter. The inner diameter of the thick-wall portion 41 is substantially the same as the outer diameter of the first and second collar portions 25, 30 of the primary spool 18. The thick-wall portion 41 is press-inserted to the outer circumferential periphery of the first and second collar portions 25, 30 via the extended portion 21*b* of the thin film sheet 21 (FIG. 2). Thus, the thick-wall portion 41 seals a space formed between the primary winding 19 and the thin film sheet 21. The thick-wall portion 41 includes a bracket (not shown) that supports lead portions 19*a* of the primary winding 19. As referred to FIG. 4, the primary winding 19 has a pair of the lead portions 19*a* that is wound around the bent space 37, which is formed of the first groove portions 26 of the first collar portion 25, the annular groove 35, and second groove portions 31 of the second collar portion 30. The lead portions 19*a* of the primary winding 19 are supported by the bracket provided to the thick-wall portion 41 of the sub-assembly 40. The thin-wall portion 43 of the sub-assembly 40 engages with the upper end portion of the outer core 23.

As referred to FIG. 1, the control portion 45 has a circuit case 46 that includes a receiving portion 47, a connector portion 48, and a connecting portion 49. The circuit case 46, which is formed in a box-shape, receives an igniter 51. The connector portion 48, which extends from the minus side of the receiving portion 47, receives a terminal 52 that is electrically connected with both the igniter 51 and the primary winding 19. The space around the igniter 51 in the receiving portion 47 is filled with an electrically insulative thermosetting resin (not shown). The connecting portion 49, which extends from the lower plane of the receiving portion 47, is in a substantially cylindrical shape. The inner diameter of the connecting portion 49 is slightly smaller than the outer diameter of the sub-assembly 40. The sub-assembly 40 is press-inserted into the primary spool 18, and the connecting portion 49 is press-inserted into the sub-assembly 40, so that the control portion 45 is fixed to the coil portion 10.

Next, an assembly process of the stick-shaped ignition coil is described. As referred to FIG. 1, the secondary coil 13 is inserted into the inner circumferential periphery of the primary coil 17. The center core 11 is inserted into the inner circumferential periphery of the secondary coil 13, so that the coil portion 10 is assembled. The control portion 45, which is individually assembled, is connected to the coil portion 10. The sub-assembly 40 is connected to both the thin film sheet 21 and the outer core 23 that are assembled to the outer circumferential periphery of the primary coil 17.

The thick-wall portion 41 of the sub-assembly 40 is press-inserted to the outer circumferential periphery of the extended portion 21*b* of the thin film sheet 21 that circumferentially covers the first and second collar portions 25, 30 of the primary spool 18. Simultaneously, the thin-wall portion 43 of the sub-assembly 40 is engaged with the outer circumferential periphery of the outer core 23. In this situation, as referred to FIG. 4, the lead portions 19*a* of the primary winding 19 are hooked to one of the protrusions 32 of the second collar portion 30 and one of the protrusions 27 of the first collar portion 25, so that the lead portions 19*a* are bent along the protrusions 27, 32 in a substantially crank-shape. Thus, the lead portions 19*a* are arranged along the bent space 37, which is formed of the first groove portions 26 of the first collar portion 25, the annular groove 35, and second groove portions 31 of the second collar portion 30.

As referred to FIG. 1, the igniter 51 and the terminal 52 are arranged in the circuit case 46 of the control portion 45 in advance, and the control portion 45 is connected to the coil portion 10. The connecting portion 49 of the circuit case 46 is press-inserted to the outer circumferential periphery of the sub-assembly 40 axially for a predetermined length, and the connecting portion 49 is positioned relative to the coil portion 10 in the axial direction and the radial direction thereof. The lead portions 19*a* of the primary winding 19, which is supported by the bracket of the sub-assembly 40, is connected to the terminal 52. The connecting portion 49 radially inwardly presses the sub-assembly 40 to the side of the inner circumferential periphery of the sub-assembly 40. Thus, the sub-assembly 40 (FIG. 2) radially inwardly presses the extended portion 21*b* of the thin film sheet 21 onto the outer circumferential periphery of the first and second collar portions 25, 30 of the primary spool 18. Electrically insulative thermosetting resin is injected into a space formed in the circuit case 46, so that the melted resin flows over the space in the circuit case 46. Thus, the gap formed between the secondary winding 15 and the primary spool 18, the gap formed between the primary winding 19 and the thin film sheet 21, and the like can be filled with the electrically insulative thermosetting resin.

The intermediately outer circumferential portion of the coil portion 10 is formed of the thin film sheet 21, which has the wall thickness that is in a range from substantially half to substantially one-third of a wall thickness of a conventional resinous case. Thus, the coil portion 10 is significantly reduced in outer diameter.

In the above structure, two collar portions 25, 30 are formed on the primary spool 18. At least two collar portions 25, 30 may be formed on the primary spool 18. In this structure, the contact area between the primary spool 18 and the sub-assembly 40 becomes larger compared with a structure, in which only one collar portion 30 is formed on the primary spool 18 to form a receiving concavity of the primary winding 19. Rigidity of the connecting portion between the primary spool 18 and the sub-assembly 40 can be enhanced by increasing the number of the collar portions. Thus, the primary spool 18 can be rigidly connected to the circuit case 46, even the intermediately outer circumferential portion of the coil portion 10 is formed of the thin film sheet 21, which is not so rigid as a conventional resinous coil case. Additionally, compression force, which is applied to a connecting portion, in which the first and second collar portions 25, 30 contact with the thin film sheet 21, is increased according to a result of analysis of compression force applied to the inner circumferential periphery of the sub-assembly 40.

The extended portion 21*b* of the thin film sheet 21, which circumferentially covers the first and second collar portions 25, 30, are pressed onto the first and second collar portions 25, 30 by the sub-assembly 40. As a result, the gap between the sub-assembly 40 and the primary spool 18 is steadily sealed by the extended portion 21*b*. Thus, resin and the like can be restricted from leaking through the gap between the sub-assembly 40 and the primary spool 18.

The lead portions 19*a* of the primary winding 19 are supported by the sub-assembly 40. Besides, the lead portions 19*a* are wound around the bent space 37, which is formed of the first groove portions 26 of the first collar portion 25, the annular groove 35, and second groove portions 31 of the second collar portion 30. Therefore, an additional member need not to be provided to the outer circumferential periphery of the primary spool 18, the first and second collar portions 25, 30. Thus, the supporting portion, which is formed on the upper end portion of the primary spool 18 to support the lead portions 19*a* of the primary winding 19, may be reduced in outer diameter.

The primary coil 17 and the outer core 23 are partitioned by the thin film sheet 21, so that internal strain, i.e., deformation arising in the outer core 23 due to heating and cooling can be reduced.

(Variation of First Embodiment)

Figure 5:
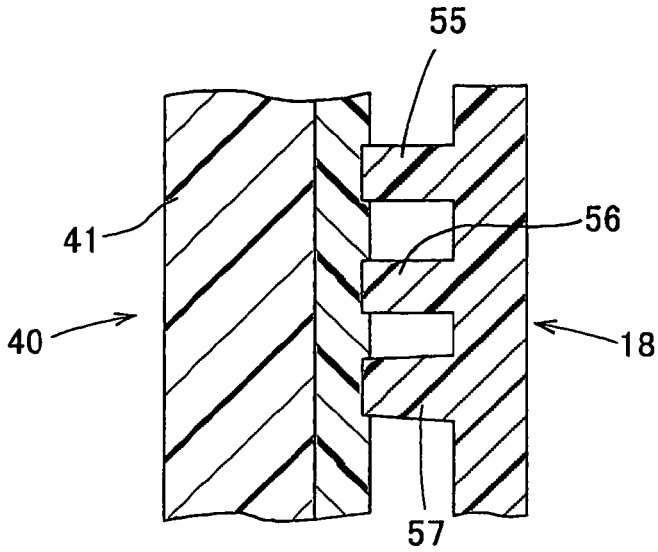
FIG. 5 is a schematic side view showing a primary spool connected to a sub-assembly in an ignition coil according to a variation of the first embodiment.

As shown in FIG. 5, a first collar portion 55, a second collar portion 56, and a third collar portion 57 are formed on the outer circumferential periphery of the upper end portion of the primary spool 18. The first, second, third portions 55, 56, 57 are apart from each other respectively for a predetermined distance in the axial direction of the primary spool 18. Each of the first, second, third portions 55, 56, 57 has multiple grooves (not shown). The structure of the ignition coil of this variation is substantially the same as the structure of the first embodiment excluding the first, second, third portions 55, 56, 57.

Thus, the contact area between the primary spool 18 and the sub-assembly 40 can be increased by forming the first, second, third portions 55, 56, 57. Besides, the distance between the collar portions, i.e., the first and third collar portions 55, 57, which are arranged on the axially end sides, increases. As a result, the axial length of the connecting portion between the primary spool 18 and the sub-assembly 40 increases, so that mechanical strength, especially flexural rigidity of the connecting portion can be further enhanced.

(Second Embodiment)

Figure 6:
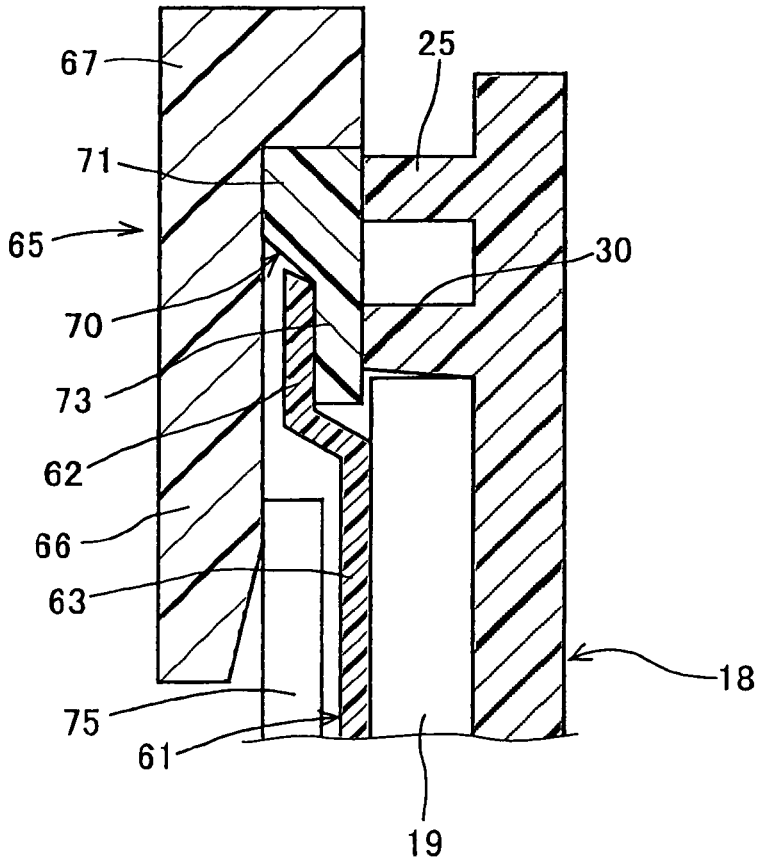
FIG. 6 is a schematic side view showing a primary spool connected to a sub-assembly in an ignition coil according to a second embodiment of the present invention.

As shown in FIG. 6, the intermediately outer circumferential portion is constructed of a shrinkable tube 61 instead of the thin film sheet 21. Besides, a reinforcing ring 70 is inserted between the primary spool 18 and a sub-assembly 65. Specifically, the reinforcing ring 70 is press-inserted to the outer circumferential periphery of the first and second collar portions 25, 30 of the primary spool 18. The reinforcing ring 70 is longitudinally substantially uniform in inner diameter. The upper portion (thick-wall portion 71) of the reinforcing ring 70 is larger than the lower portion (thin-wall portion 73) of the reinforcing ring 70 in outer diameter. The thick-wall portion 71 and the thin-wall portion 73 are press-inserted to the outer circumferential periphery of the first and second collar portions 25, 30 of the primary spool 18. The shrinkable tube 61 has a body portion 63, which circumferentially covers the primary winding 19, and an extended portion 62, which circumferentially covers the thin-wall portion 73 of the reinforcing ring 70. The sub-assembly 65 is longitudinally substantially uniform in outer diameter. The upper portion (thick-wall portion 67) of the sub-assembly 65 is smaller than the lower portion (thin-wall portion 66) in inner diameter. The thin-wall portion 66 of the sub-assembly 65 has a root portion, in which the thin-wall portion 66 downwardly extends from the thick-wall portion 67. The root portion of the thin-wall portion 66 is press-inserted to the outer circumferential periphery of the thick-wall portion 71 of the reinforcing ring 70.

The reinforcing ring 70 is press-inserted to the outer circumferential periphery of the first and second collar portions 25, 30 of the primary spool 18. The shrinkable tube 61 is attached to the outer circumferential periphery of the primary winding 19 and the thin-wall portion 73 of the reinforcing ring 70. The shrinkable tube 61 is heated, and the shrinkable tube 61 shrinks, so that the shrinkable tube 61 tightly makes contact with the outer circumferential periphery of the primary winding 19 and the thin-wall portion 73 of the reinforcing ring 70. Subsequently, an outer core 75 is assembled to the outer circumferential periphery of the shrinkable tube 61, and the thin-wall portion 66 of the sub-assembly 65 is press-inserted to the thick-wall portion 71 of the reinforcing ring 70. Thus, the assembling process is completed.

The intermediately outer circumferential portion of the plug portion is constructed of the shrinkable tube 61 instead of the thin film sheet 21 in the second embodiment. The shrinkable tube 61 has small wall thickness as well as the thin film sheet 21, so that the coil portion can be reduced in outer diameter. The circuit case 46 is connected to the primary spool 18 via the first and second collar portions 25, 30 of the primary spool 18, so that mechanical strength of the connecting portion between the primary spool 18 and the sub-assembly 65 can be enhanced. Furthermore, the reinforcing ring 70 protects the extended portion 62 of the shrinkable tube 61 from being peeled when the sub-assembly 65 is press-inserted to the side of the outer circumferential periphery of the shrinkable tube 61. Specifically, the thin-wall portion 73, which is the lower portion of the reinforcing ring 70, forms a small-diameter portion of the reinforcing ring 70. Besides, a step portion is formed axially between the thin-wall portion 73 and the thick-wall portion 71, so that a concavity portion is formed on the outer circumferential periphery of the reinforcing ring 70. The concavity portion is covered with the extended portion 62 of the shrinkable tube 61. Therefore, the outer diameter of the thick-wall portion 71, which is the upper portion of the reinforcing ring 70, is substantially the same as the outer diameter of the shrinkable tube 61 covering the thin-wall portion 73 that is the lower portion of the reinforcing ring 70. Therefore, the outer circumferential peripheries of both the thick-wall portion 71 and the shrinkable tube 61 become substantially flat, and a step may not formed axially therebetween. Thus, the extended portion 62 is not apt to be peeled, so that the primary spool 18 and the sub-assembly 65 can be stably connected, and leakage of electrically insulative resin can be restricted through the connecting portion.

(Third Embodiment)

Figure 7:
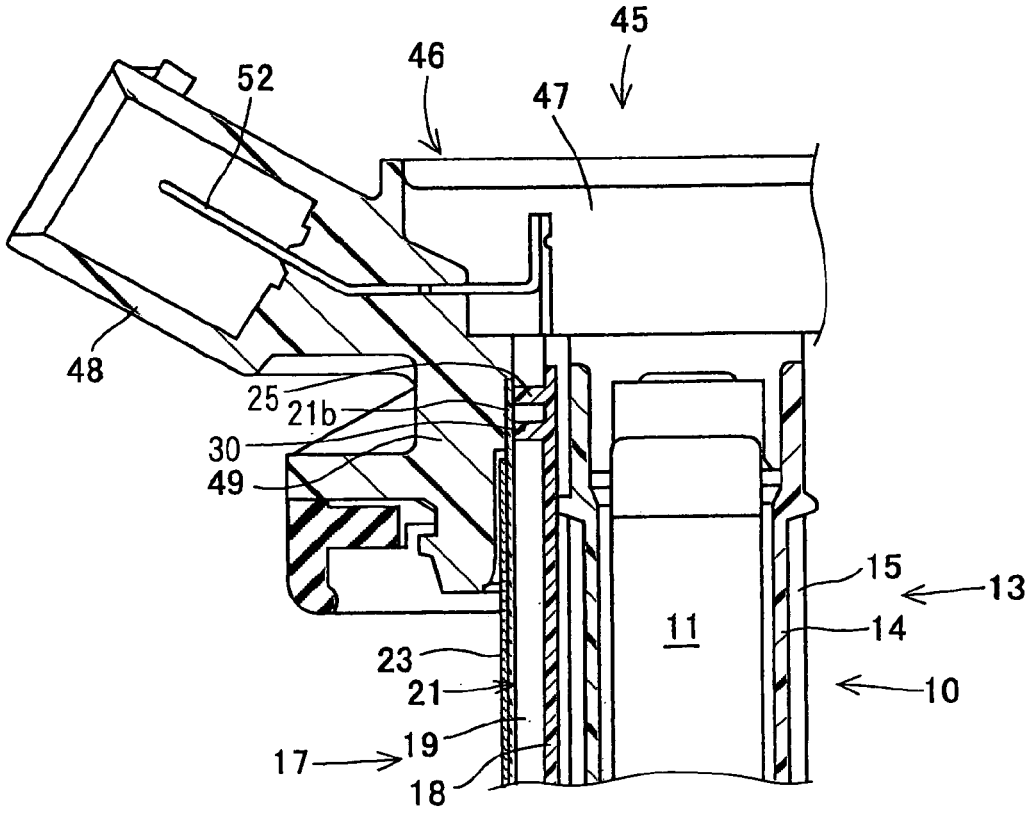
FIG. 7 is a partially cross-sectional side view showing a coil portion and a control portion of an ignition coil according to a third embodiment of the present invention.

In this embodiment, as shown in FIG. 7, the sub-assembly 40 is reduced from the coil portion 10, and the igniter 51 is reduced from the circuit case 46 of the control portion 45 from the structure of the coil portion 10 of the first embodiment. That is, the connecting portion 49 of the circuit case 46 is directly press-inserted to the outer circumferential periphery of the first and second collar portions 25, 30 of the primary spool 18 via the extended portion 21*b* of the thin film sheet 21 without inserting the sub-assembly 40 therebetween. The lead portions of the primary winding 19 is connected to the terminal 52 after passing through the space, i.e., the bent space 37 (FIG. 4) formed between the first and second collar portions 25, 30 of the primary spool 18. In this structure, the primary spool 18 is steadily connected to the circuit case 46 via the first and second collar portions 25, 30. Besides, the gap between the thin film sheet 21 and the primary spool 18 can be steadily sealed by the connecting portion 49 of the circuit case 46. Furthermore, the coil portion 10 can be further reduced in outer diameter by reducing the sub-assembly 40. Thus, the number of the components is reduced, so that production cost of the plug portion 10 can be reduced. The igniter 51 may be provided to the outside of the circuit case 46 of the control portion 45.

(Variation)

Variations of the primary spool 18 are described as follows. The following variations can be applied to the structure of the above embodiments. The following variations and the structure of the above embodiments can be combined as appropriate.

Figure 8A:
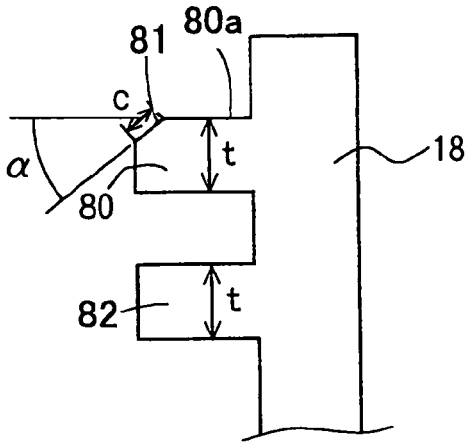
FIGS. 8A, 8B, 8C are schematic side views respectively showing a primary spool according to a variation of the third embodiment of the present invention.

As shown in FIG. 8A, a first variation of the primary spool 18 has a first collar portion 80 and a second collar portion 82 that are apart from each other for a predetermine length in the axial direction of the primary spool 18. The wall thickness t of the first and second collar portions 80, 82 are respectively substantially 1 mm. A chamfer edge 81 is formed on the upper circumferential periphery of the first collar portion 80, which is arranged in the vicinity of the upper end portion of the primary spool 18, i.e., on the side of the circuit case 46 of the control portion 45. That is, the upper circumferential periphery of the first collar portion 80 is formed to be the chamfer edge 81 that has a shape partially circumferentially shaved. The chamfer edge 81 has a chamfer width c that is substantially 0.5 mm. The chamfer edge 81 has a chamfer angle $\alpha$ that is substantially 45° with respect to an upper end face 80*a* of the first collar portion 80.

Figure 8B:
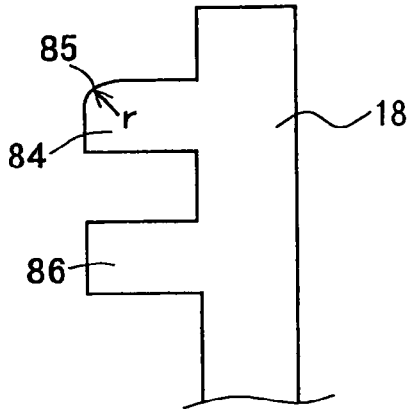

As shown in FIG. 8B, a second variation of the primary spool 18 has a first collar portion 84 and a second collar portion 86 that are axially apart from each other for a predetermine length. An arc portion 85 is formed on the upper circumferential periphery of the first collar portion 84, which is located on the upper side. The cross section of the arc portion 85 is a substantially quadrant with respect to the circumferential direction of the first collar portion 84. The radius r of the quadrant-shaped cross section of the arc portion 85 is substantially 0.5 mm.

Figure 8C:
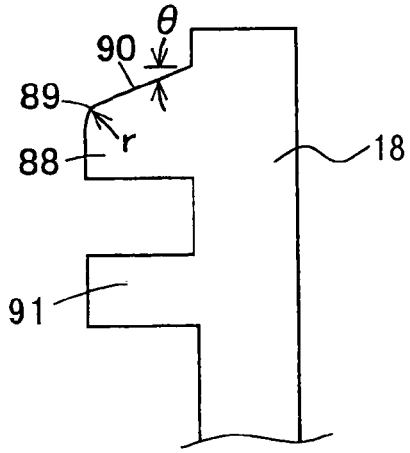
Figure 10:
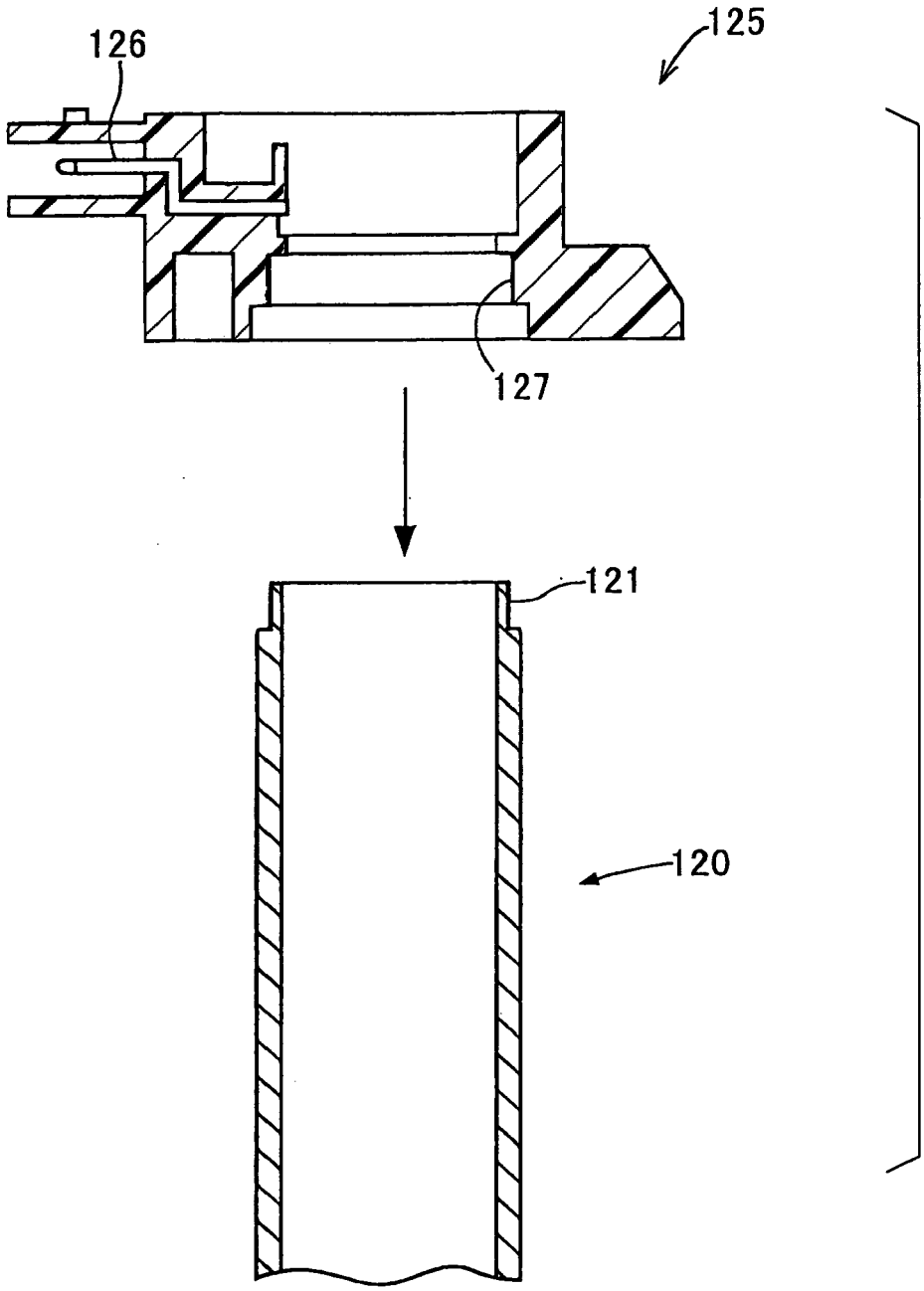
FIG. 10 PRIOR ART
FIG. 10 is a partially cross-sectional side view showing a coil case and a circuit case according to a prior art.

As shown in FIG. 8C, a third variation of the primary spool 18 has a first collar portion 88 and a second collar portion 91 that are axially apart from each other. The upper end face of the first collar portion 88, which is located on the upper side of the primary spool 18, is an inclined face 90. An arc portion 89 is formed on the upper circumferential periphery of the first collar portion 88. The cross section of the arc portion 89 is a substantially arc-shape with respect to the circumferential direction of the first collar portion 88. The radius r of the arc-shaped cross section of the arc portion 89 is substantially 1 mm. The inclined face 90 of the first collar portion 88 is downwardly inclined at an angle θ that is substantially 30° with respect to the upper face of the first collar portion 25 of the first embodiment shown in FIG. 2.

Figure 9A:
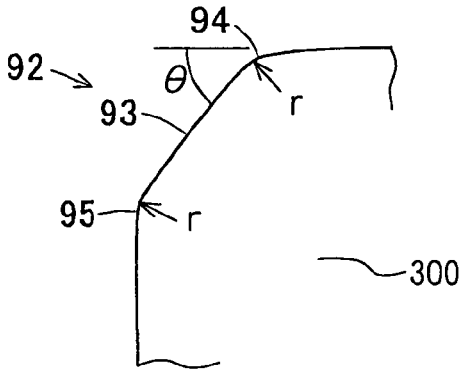
FIGS. 9A, 9B are schematic enlarged side views respectively showing a primary spool according to a variation of the third embodiment of the present invention.

As shown in FIG. 9A, a fourth variation of the primary spool 18 has a first collar portion 300. A round portion 92 is formed on the upper circumferential periphery of the first collar portion 300. The round portion 92 includes a flat portion 93, and arc portions 94, 95. The arc portions 94, 95 are connected with each other via the flat portion 93. The flat portion 93 is downwardly inclined at an angle θ that is substantially 45°. The length of the flat portion 93 is substantially 0.3 mm. The radius r of the cross section of the round portion 92 is substantially 0.5 mm.

Figure 9B:
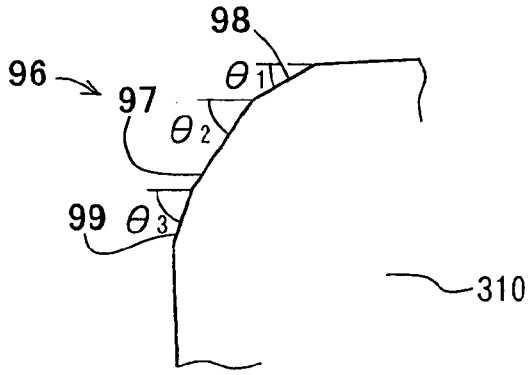

As shown in FIG. 9B, a fifth variation of the primary spool 18 has a first collar portion 310. A round portion 96 is formed on the upper circumferential periphery of the first collar portion 310. The round portion 96 includes a center flat portion 97, and flat portions 98, 99. The flat portions 98, 99 are connected with each other via the center flat portion 97. The center flat portion 97, and flat portions 98, 99 respectively have a length that is substantially 0.3 mm. The flat portion 98 is downwardly inclined at an angle θ1 that is substantially 30°. The center flat portion 97 is downwardly inclined at an angle θ2 that is substantially 45°. The center flat portion 99 is downwardly inclined at an angle θ3 that is substantially 60°. Second collar portions of the first to fifth variations of the primary spool 18 may be formed in a shape equivalent to the shape of the first collar portions 80, 84, 88, 300, 310.

According to the first to fifth variations, the primary spool 18 has one of the first collar portions 80, 84, 88, 300, 310 having the chamfer edge 81, the arc portions 85, 89, the round portions 92, 96 or the like. The outer circumferential periphery of the primary spool 18 initially upwardly makes contact with the opening end brim of the connecting portion 49 of the circuit case 46, when the upper end portion of the primary spool 18 is press-inserted to the circuit case 46. In this situation, the circuit case 46 can be smoothly press-inserted to the upper end portion of the primary spool 18 because of forming the chamfer edge 81 or the like. The chamfer edge 81, the arc portions 85, 89, the round portions 92, 96 and the like are intentionally formed on the primary spool 18 for smooth insertion, and are to be distinguished from a round portion that is unintentionally formed in a manufacturing process of the primary spool 18.

When the number of the collar portions (annular protrusions) 25, 30, 55, 56, 57, 80, 82, 84, 86, 88, 91, 300, 310 is two, the upper side of the outer circumferential periphery of the annular protrusion, which is on the upper side of the primary spool 18, is preferably rounded, i.e., chamfered. The upper side of the primary spool 18 is the side, to which the circuit case 46 is inserted to the primary spool 18. When the number of the collar portions is at least three, the upper side of the outer circumferential periphery of the collar portion, which is on the upper and/or middle side of the primary spool 18, is preferably rounded. Thus, the primary spool 18 can be easily press-inserted into the circuit case 46.

The round portion of the annular protrusion may be the arc-shaped portion 85, 89, 92, 96 and/or the chamber edge 81. The radius r of the arc-shaped portion 85, 89, 92, 96 may be in a range from substantially 0.3 mm to substantially 2.0 mm. The chamfer width c of the chamfer edge 81 may be in a range from substantially 0.3 mm to substantially 2.0 mm. The radius r of the arc-shaped portion 85, 89, 92, 96 may be in a range from substantially one-third of the wall thickness t of the collar portion 84, 88, 300, 310 to substantially two-thirds of the wall thickness t. The chamfer width c of the chamfer edge 81 may be in a range from substantially one-fourth of the wall thickness t to substantially three-fourths of the wall thickness t. The round portion may be formed of at least one arc portion 85, 89, 92, 96 and at least one chamfer portion 81.

The stick-shape ignition coil includes the coil portion 10 and the circuit case 46. The coil portion 10 includes the primary and secondary coils 13, 17 that are arranged on the circumferentially outer side of the center core 11. The primary and secondary coils 13, 17 may be covered with the thin film sheet 21. The thin film sheet 21 may be covered with a sub-assembly 40, 65, and the outer core 23.

The thin film sheet 21 may be reduced from the coil portion 10 of the third embodiment. In this case, the coil portion 10 is referred to a first-type coil portion 10 that includes the primary and secondary coils 13, 17, the collar portions 25, 30, and the circuit case 46 excluding the thin film sheet 21. In the first-type coil portion 10, the receiving portion of the primary and secondary coils 13, 17 is the circuit case 46. The primary spool 18, which is arranged on the outer circumferential side with respect to the secondary spool 14, is radially connected with the circuit case 46 via the collar portions 25, 30. In the structure of the first-type coil portion 10, connecting strength between the primary spool 18 and the circuit case 46 becomes higher than a structure of a coil portion, in which the collar portions 25, 30 are not formed, or only one of the collar portions 25, 30 is formed.

The coil portion 10 of the third embodiment is referred to a second-type coil portion 10 that includes the primary and secondary coils 13, 17, the collar portions 25, 30, the circuit case 46, and the thin film sheet 21. In the second-type coil portion 10, the receiving portion of the primary and secondary coils 13, 17 is the thin film sheet 21. The thin film sheet 21 circumferentially covers the collar portions 25, 30 formed on the primary spool 18 of the primary coil 17. The primary spool 18 is radially connected with the circuit case 46 via the collar portions 25, 30 and the thin film sheet 21. In the structure of the second-type coil portion 10, the thin film sheet 21 is used instead of a conventional resinous coil case, so that the coil portion 10 can be reduced in outer diameter. Besides, the primary spool 18 and the circuit case 46 are connected with each other via the collar portions 25, 30, so that connecting strength is enhanced therebetween. The extended portion 21*b* of the thin film sheet 21 is inserted between the primary spool 18 and the circuit case 46, so that the gap between the circuit case 46 and the primary spool 18 and the gap between the thin film sheet 21 and the primary winding 19 can be steadily sealed.

The coil portion 10 of the first embodiment is referred to a third-type coil portion 10 that includes the primary and secondary coils 13, 17, the collar portions 25, 30, the circuit case 46, the thin film sheet 21, and the sub-assembly (cylindrical member) 40. In the third-type coil portion 10, the receiving portion of the primary and secondary coils 13, 17 is the thin film sheet 21. The thin film sheet 21 circumferentially covers the collar portions 25, 30 formed on the primary spool 18 of the primary coil 17. The sub-assembly 40 circumferentially covers the thin film sheet 21. The primary spool 18 is radially connected with the circuit case 46 via the collar portions 25, 30, the thin film sheet 21, and the sub-assembly 40.

Here, an ignition coil disclosed in JP-A-11-16753 has a structure, in which the primary spool, which is arranged on the outer circumferential side, has an upper end portion that engages with a ring. However, the ring only seals a gap, which is formed between the primary spool and a coil case, filled with electrically insulative resin. Besides, the coil case is the same as a conventional coil case in wall thickness, and the coil case is not reduced in wall thickness.

In the structure of the third-type coil portion 10, the thin film sheet 21 is used instead of a conventional resinous coil case, so that the coil portion 10 can be reduced in outer diameter. Besides, the primary spool 18 and the circuit case 46 are connected with each other via the collar portions 25, 30, so that connecting strength is enhanced therebetween. Besides, the extended portion 21*b* of the thin film sheet 21 is inserted between the primary spool 18 and the sub-assembly 40, so that the gap between the sub-assembly 40 and the primary spool 18 and the gap between the thin film sheet 21 and the primary winding 19 can be steadily sealed. The lead portion of the primary winding 19 is supported by the sub-assembly 40, so that the supporting portion of the primary spool 18 can be downsized. The second groove portions 31 of the second collar portion 30 is staggered substantially 90° apart from the first groove portions 26 of the first collar portion 25 in the circumferential direction of the primary spool 18. Thus, the lead portion of the primary winding 19 can be easily and steadily supported by the first and second collar portions 25, 30 without increasing the outer diameter of the coil portion 10.

The outer core 23 is provided to the outermost periphery of the coil portion 10, so that the primary winding 19 can be protected by the thin film sheet 21 from being damaged, when the outer core 23 is assembled to the side of the outer circumferential periphery of the primary winding 19.

The coil portion 10 of the second embodiment is referred to a fourth-type coil portion 10 that includes the primary and secondary coils 13, 17, the collar portions 25, 30, the circuit case 46, the shrinkable tube 61, the reinforcing ring (annular member) 70, and the sub-assembly (cylindrical member) 65. In the fourth-type coil portion 10, the receiving portion of the primary and secondary coils 13, 17 is the shrinkable tube 61. The shrinkable tube 61 circumferentially covers the collar portions 25, 30 formed on the primary spool 18 of the primary coil 17 via the reinforcing ring 70. The sub-assembly 65 circumferentially covers the shrinkable tube 61 and the reinforcing ring 70. The primary spool 18 is radially connected with the circuit case 46 via the collar portions 25, 30, the reinforcing ring 70, and the sub-assembly 65. In the structure of the fourth-type coil portion 10, the shrinkable tube 61 is used instead of a conventional resinous coil case, so that the coil portion 10 can be reduced in outer diameter. Besides, the primary spool 18 and the circuit case 46 are connected with each other via the collar portions 25, 30, the reinforcing ring 70 and the sub-assembly 65, so that connecting strength is enhanced therebetween. The lead portion of the primary winding 19 is supported by the sub-assembly 65, so that the supporting portion of the primary spool 18 can be downsized. The reinforcing ring 70 is arranged between the primary spool 18 and the sub-assembly 65, so that the upper end portion of the shrinkable tube 61 can be protected from deformation when the sub-assembly 65 is press-inserted into the circuit case 46.

The shrinkable tube 61 is equivalent to the thin film sheet 21, and either the shrinkable tube 61 or the thin film sheet 21 may be used in the coil portion 10 as appropriate.

The primary coil 17 may be arranged on the inner peripheral side with respect to the secondary coil 13 in the radial direction of the coil portion 10. Even in this structure, current can be supplied and shut by the igniter 51, so that high-voltage current can be generated using the primary and secondary coils 13, 17, as well as a generally known ignition coil.

The number of the collar portions may be at least two. The number and various dimensions of the collar portions may be determined in consideration of stress arising in the connecting portion, in which the collar portions radially presses onto the thin film sheet 21, after the primary spool is press-inserted to the circuit case 46 via the thin film sheet 21, for example. The various dimensions of the collar portions are such as the height, i.e., radially extending amount of each collar portion, the width of the collar portion, i.e., the length of the collar portion in the axial direction of the primary spool 18, the cross-sectional shape of the collar portion with respect to the circumferential direction of the primary spool 18, and the distance between the collar portions which are adjacent each other.

The lead portions 19*a* are wound around the bent space 37, which is formed of the first and second groove portions 26, 31 and the annular groove 35. The bent space 37 may be a passage of electrically insulative resin. The gap formed between the primary winding 19 and the thin film sheet 21 is filled with the electrically insulative resin.

The sub-assembly 40, 65 are in a substantially cylindrical shape or a substantially annular shape. The sub-assembly 40, 65 has the supporting portion of the lead portion of the primary winding 19. The sub-assembly 40, 65 severs as an interface between the primary spool 18 and the circuit case 46 of the control portion 45. The sub-assembly 40, 65 has a predetermined axial length. The inner circumferential periphery of the sub-assembly 40, 65 has a shape and dimension that is suitable to be press-inserted to the primary spool 18. The outer circumferential periphery of the sub-assembly 40, 65 has a shape and dimension that is suitable to be press-inserted to the circuit case 46.

The outer diameter and/or inner diameter of the sub-assembly 40, 65 may be substantially the same over the total axial length thereof. Alternatively, the upper portion and the lower portion of the sub-assembly 40, 65 may have different outer diameter and/or inner diameter therebetween. The sub-assembly 40, 65 may not be provided to the coil portion 10.

The reinforcing ring 70, which is inserted between the upper portion of the primary spool 18 and the sub-assembly 65, effectively protect the shrinkable tube 61, when the shrinkable tube 61 is provided to the side of the outermost circumferential periphery of the coil portion 10.

The outer diameter and/or inner diameter of the reinforcing ring 70 may be substantially the same over the total axial length thereof. Alternatively, the upper and lower portions of the reinforcing ring 70 may have different outer diameter and/or inner diameter therebetween. The reinforcing ring 70 may not be provided to the coil portion 10.

The thin film sheet 21 is made of resin that is thermally resistive in a condition of temperature such as 100° C. to 150° C. The thin film sheet 21 has a cylindrical shape that corresponds to the shapes of both the primary spool 18 and the outer core 23. The thin film sheet 21 is formed using injection molding or extrusion such that the thickness of the thin film sheet 21 is in a range from substantially 0.05 mm to substantially 0.4 mm. The thin film sheet 21 may be arranged on the side of the outer circumferential periphery of the outer core 23. The shrinkable tube 16 may be used instead of the thin film sheet 21.

The circuit case 46 of the control portion 45 may include the igniter 51 and the terminal 52. The circuit case 46 is preferably has the connecting portion in a cylindrical shape that is press-inserted to the coil portion 10. When the circuit case 46 of the control portion 45 includes the igniter 51 and the like, the control portion 45, which is constructed of the circuit case 46, the igniter and the like, controls the coil portion 10. When the circuit case 46 does not include the igniter 51, the coil portion 10 may be connected with an external ignition apparatus (not shown) via the circuit case 46.

The structures of the above embodiments and variations can be combined as appropriate.

Various modifications and alternations may be diversely made to the above embodiments without departing from the spirit of the present invention.

What is claimed is:

1. A stick-shaped ignition coil comprising:

a secondary coil that includes a secondary spool and a secondary winding, the secondary winding wound around the secondary spool;

a primary coil that includes a primary spool and a primary winding, the primary winding wound around the primary spool, wherein the secondary coil and the primary coil are substantially coaxially arranged;

a plurality of annular protrusions that are integrally formed on an outer circumferential periphery of an upper end portion of one of the primary coil and the secondary coil that is arranged on an outer circumferential side with respect to the other of the primary coil and the secondary coil, said plurality of annular protrusions being disposed above an upper end of the winding of said one of the primary coil and secondary coil; and a case that is press-inserted to an outer circumferential periphery of the plurality of annular protrusions.

2. The stick-shaped ignition coil according to claim 1 further comprising:

a thin film sheet that covers the outer circumferential periphery of the plurality of annular protrusions, wherein the case is press-inserted to the outer circumferential periphery of the plurality of annular protrusions via the thin film sheet.

3. The stick-shaped ignition coil according to claim 1 further comprising:

a cylindrical member that is inserted between the case and the thin film sheet.

4. The stick-shaped ignition coil according to claim 1, wherein the case is a circuit case that controls one of the primary coil and the secondary coil.

5. The stick-shaped ignition coil according to claim 1, wherein at least one of the plurality of annular protrusions, which is arranged on an upper side with respect to another of the plurality of annular protrusions, which is arranged on a lowermost side, has an outer circumferential periphery on an upper side thereof, and the outer circumferential periphery defines a round portion.

6. The stick-shaped ignition coil according to claim 1, wherein the upper end portion of one of the primary coil and the secondary coil is located on a side, in which the plurality of annular protrusions is press-inserted to the case.

7. The stick-shaped ignition coil according to claim 1, wherein each said annular protrusion includes a cutout for receiving a lead portion of the winding of the respective coil.

8. The stick-shaped ignition coil according to claim 7, wherein said cutouts are circumferentially offset so that the lead portion is bent along said protrusions in substantially a crank-shape.

9. A stick-shaped ignition coil comprising:

a secondary coil that includes a secondary spool and a secondary winding, the secondary winding wound around the secondary spool;

a primary coil that includes a primary spool and a primary winding, the primary winding wound around the primary spool, wherein the secondary coil and the primary coil are substantially coaxially arranged;

a plurality of annular protrusions that are integrally formed on an outer circumferential periphery of an upper end portion of one of the primary coil and the secondary coil that is arranged on an outer circumferential side with respect to the other of the primary coil and the secondary coil, said plurality of annular protrusions being disposed above an upper end of the winding of said one of the primary coil and secondary coil;

a thin film sheet that covers:

an outer circumferential periphery of one of the primary coil and the secondary coil that is arranged on an outer circumferential side with respect to the other of the primary coil and the secondary coil; and an outer circumferential periphery of the plurality of annular protrusions; and a case that is press-inserted to the outer circumferential periphery of the plurality of annular protrusions via the thin film sheet.

10. The stick-shaped ignition coil according to claim 9, wherein the case is a circuit case that controls one of the primary coil and the secondary coil.

11. The stick-shaped ignition coil according to claim 9, wherein at least one of the plurality of annular protrusions, which is arranged on an upper side with respect to another of the plurality of annular protrusions, which is arranged on a lowermost side, has an outer circumferential periphery on an upper side thereof, and the outer circumferential periphery defines a round portion.

12. The stick-shaped ignition coil according to claim 9, wherein the upper end portion of one of the primary coil and the secondary coil is located on a side, in which the plurality of annular protrusions is press-inserted to the case.

13. The stick-shaped ignition coil according to claim 9, wherein each said annular protrusion includes a cutout for receiving a lead portion of the winding of the respective coil.

14. The stick-shaped ignition coil according to claim 13, wherein said cutouts are circumferentially offset so that the lead portion is bent along said protrusions in substantially a crank-shape.

15. A stick-shaped ignition coil comprising:

a secondary coil that includes a secondary spool and a secondary winding, the secondary winding wound around the secondary spool;

a primary coil that includes a primary spool and a primary winding, the primary winding wound around the primary spool, wherein the secondary coil and the primary coil are substantially coaxially arranged;

a plurality of annular protrusions that are integrally formed on an outer circumferential periphery of an upper end portion of one of the primary coil and the secondary coil that is arranged on an outer circumferential side with respect to the other of the primary coil and the secondary coil;

a thin film sheet that covers:

an outer circumferential periphery of one of the primary coil and the secondary coil that is arranged on an outer circumferential side with respect to the other of the primary coil and the secondary coil; and an outer circumferential periphery of the plurality of annular protrusions;

a cylindrical member that is press-inserted to the outer circumferential periphery of the plurality of annular protrusions via the thin film sheet, the cylindrical member being electrically insulative, the cylindrical member supporting a lead portion of one of the primary winding and secondary winding; and a case that is press-inserted to an outer circumferential periphery of the cylindrical member.

16. The stick-shaped ignition coil according to claim 15, wherein the plurality of annular protrusions includes a first annular protrusion and a second annular protrusion that are apart from each other in an axial direction of the primary coil, the first annular protrusion defines at least one first groove portion that extends in a substantially axial direction of the primary coil, the second annular protrusion defines at least one second groove portion that extends in the substantially axial direction of the primary coil, the at least one first groove portion is staggered with respect to the at least one second groove portion in a circumferential direction of the one of the primary coil and the secondary coil, and one of the primary winding and the secondary winding, which is arranged on an outer circumferential side with respect to the other of the primary winding and the secondary winding, is at least partially arranged in a bent space that is formed of at least one first groove portion, an annular space, which is formed between the first annular protrusion and the second annular protrusion, and the at least one second groove portion.

17. The stick-shaped ignition coil according to claim 15 further comprising:

an outer core that is arranged on a side of an outer circumferential periphery of the thin film sheet.

18. The stick-shaped ignition coil according to claim 15, wherein the case is a circuit case that controls one of the primary coil and the secondary coil.

19. The stick-shaped ignition coil according to claim 15, wherein at least one of the plurality of annular protrusions, which is arranged on an upper side with respect to another of the plurality of annular protrusions, which is arranged on a lowermost side, has an outer circumferential periphery on an upper side thereof, and the outer circumferential periphery defines a round portion.

20. The stick-shaped ignition coil according to claim 15, wherein the upper end portion of one of the primary coil and the secondary coil is located on a side, in which the plurality of annular protrusions is press-inserted to the case.

21. A stick-shaped ignition coil comprising:

a secondary coil that includes a secondary spool and a secondary winding, the secondary winding wound around the secondary spool;

a primary coil that includes a primary spool and a primary winding, the primary winding wound around the primary spool, wherein the secondary coil and the primary coil are substantially coaxially arranged;

a shrinkable tube that covers an outer circumferential periphery of one of the primary winding and the secondary winding that is arranged on an outer circumferential side with respect to the other of the primary winding and the secondary winding;

a plurality of annular protrusions that are integrally formed on an outer circumferential periphery of an upper end portion of one of the primary coil and the secondary coil that is arranged on an outer circumferential side with respect to the other of the primary coil and the secondary coil;

an annular member that is press-inserted to an outer circumferential periphery of the plurality of annular protrusions, the annular member being electrically insulative;

a cylindrical member that is press-inserted to an outer circumferential periphery of the annular member, the cylindrical member being electrically insulative, the cylindrical member supporting a lead portion of one of the primary winding and secondary winding; and a case that is press-inserted to an outer circumferential periphery of the cylindrical member.

22. The stick-shaped ignition coil according to claim 21, wherein the shrinkable tube has an upper end portion that partially covers the outer circumferential periphery of the annular member.

23. The stick-shaped ignition coil according to claim 21, wherein the case is a circuit case that controls one of the primary coil and the secondary coil.

24. The stick-shaped ignition coil according to claim 21, wherein at least one of the plurality of annular protrusions, which is arranged on an upper side with respect to another of the plurality of annular protrusions, which is arranged on a lowermost side, has an outer circumferential periphery on an upper side thereof, and the outer circumferential periphery defines a round portion.

25. The stick-shaped ignition coil according to claim 21, wherein the upper end portion of one of the primary coil and the secondary coil is located on a side, in which the plurality of annular protrusions is press-inserted to the case.

* * * * *